United States Patent [19]

Dubner et al.

[11] Patent Number: 4,710,985

[45] Date of Patent: Dec. 8, 1987

[54] PROTECTIVE HEADGEAR FOR WRESTLER

[75] Inventors: Robert Dubner; Russel S. Dubner; Todd A. Dubner, all of Roslyn Harbor, N.Y.

[73] Assignee: Rebound Systems, Inc., Roslyn Harbor, N.Y.

[21] Appl. No.: 356,901

[22] Filed: Mar. 10, 1982

[51] Int. Cl.[3] ..... A63B 71/10

[52] U.S. Cl. ..... 2/425

[58] Field of Search ..... 2/425, 421, 423, 410, 2/9, 209, 2

[56] References Cited

U.S. PATENT DOCUMENTS

| | | | |
|---|---|---|---|
| 2,898,596 | 8/1959 | Keen | 2/425 X |
| 3,513,482 | 5/1970 | Holden | 2/421 |
| 3,596,288 | 8/1971 | Marchello | 2/425 X |

*Primary Examiner*—Peter Nerbun

[57] ABSTRACT

A wrestler's protective headgear protects the wearer's ears and is securely affixed to the head with a minimum of easily adjustable straps.

7 Claims, 7 Drawing Figures

FIG. 5
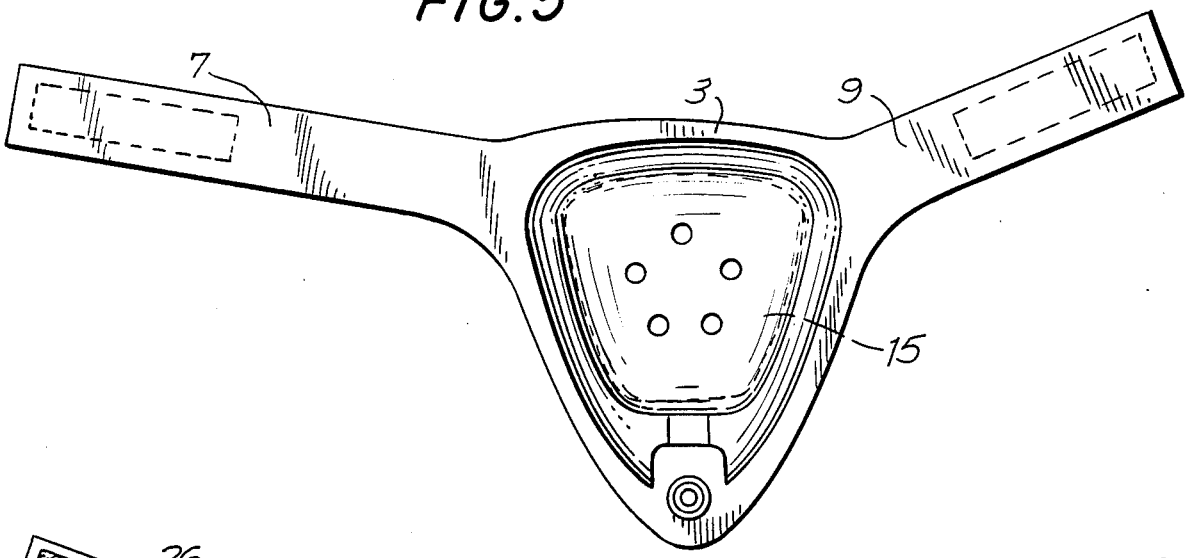
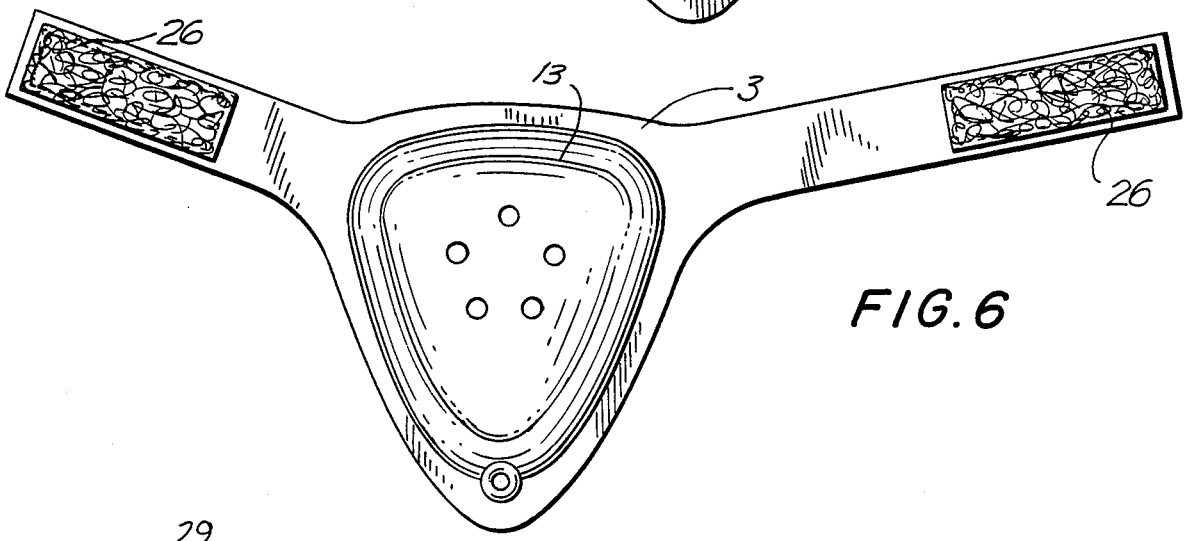
FIG. 6
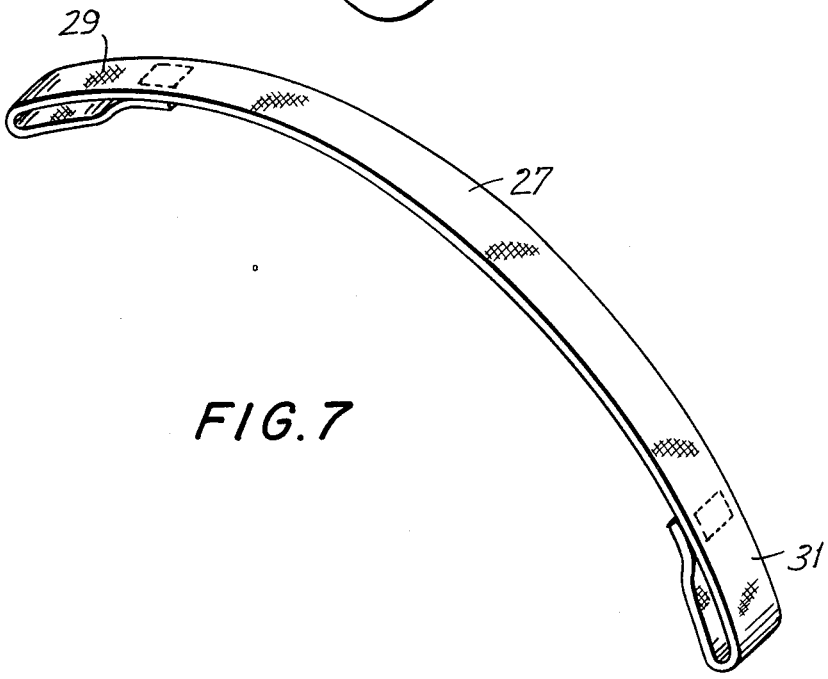
FIG. 7

PROTECTIVE HEADGEAR FOR WRESTLER

BACKGROUND OF THE INVENTION

1. FIELD OF THE INVENTION

This invention relates to protective head gear used by wrestlers and the like, particularly adopted to protect against injuries to the ear.

2. PRIOR ART

Protective head gear of the type to which this invention pertains have been known for many years. Many athletic sanctioning bodies require the use of such head gear as a prerequisite to competition. Illustrative examples are shown in Snyder, U.S. Pat. No. 2,533,526, Roberts, U.S. Pat. No. 2,886,818, Molioris, U.S. Pat. No. 3,471,865, and Otsuka, U.S. Pat. No. 3,500,475.

Keene, U.S. Pat. No. 2,898,596 discloses one such type of head gear. Ear guards are formed from a substantially rigid, non-deformable inner shell adapted to cover the wearer's ears. A flange having a flexible shock-absorbing material covers the exterior of the shell and engages the wearer's head around the ear. A plurality of straps are used to affix the ear guards to the head including straps around the chin, around the back of the head, over the top of the head and over the forehead.

Another such head gear is shown in Pukish, U.S. Pat. No. 3,327,316. In this patent each of the ear guards includes a relatively thick pad of shock-absorbing material to cover the wearer's ear, which may or may not include a rigid sheet member laminated thereto. Again a plurality of straps are used to affix the ear guards to the wearer's head.

Marchello, U.S. Pat. No. 3,596,288, discloses yet another head gear. In this version substantially triangular ear guards made of flexible vinyl have a resilient foam pad riveted to their interior. The head straps for affixing the ear guards to the wearer's head are formed integral with the exterior ear guard. The chin strap is releasably connected to the lower end and the head straps extend from the other corners of the ear guards. The head straps are adjustably joined by insertable rivets through predrilled holes, which are subsequently covered by a thin plastic tube.

All of the above prior art protective head gear suffer from serious problems. Foremost among these problems is that the helmets are either uncomfortable or provide insufficient protection. That is, if the helmets are constructed from soft and pliable materials, they do not adequately protect the wearer from impacts and other blows that might injure the ear. On the other hand, the prior art head gear having sufficiently rigid ear guards that are non-deformable under impact are uncomfortable—bulky.

Some prior art head gear attempt to cushion the ear guard. However, the bond between the cushion and the impact-resistant material is a further problem—either it is weak and allows relative movement or comprises rivets or the like which are irritants.

Another serious shortcoming of prior art devices is that they are not sufficiently immobile. Protective head gear is subjected to various pulls, tugs, pushes and shears. All of these tend to move the helmet upon the wearer's head. Some prior art devices attempted to correct this problem through a multiplicity of head straps. Unfortunately, the head gear is even more uncomfortable under the pressure of these additional straps, which in turn create the additional problem of furnishing more adjustments to properly affix the head gear to the head.

Nor does the prior art adequately solve the problem of adjustable straps to properly size the head gear to an individual through various arrangements of buckles or rivets. These too created additional irritants rendering an already uncomfortable head gear even more so.

Accordingly, it is an object of the present invention to provide a head gear for wrestlers and the like which will protect their ears from injuries to which they will be susceptible by their wearer's engagement in the selected athletic activity.

It is a further object of this invention to provide such a head gear which is relatively comfortable to wear during the athletic activity.

It is a further object of the present invention to provide such a head gear that is securely affixed to the wearer's head with a minimum of straps that are easily adjustable, but which do not provide an irritant or will not come out of adjustment during the athletic activity.

It is a further object of the present invention to provide such a head gear that is easily manufactured and competitively priced with existing head gear.

These and other objects and advantages of the invention will become apparent upon reading the remainder of the specification, description, claims, and drawings.

SUMMARY OF THE INVENTION

One embodiment of the present invention provides a protective head gear for wrestlers. A pair of ear guards have a shock-absorbing inner foam surface with a substantially triangular ridge adapted to engage the head surrounding the ear. An outer vinyl covers the ear guard. An intermediate foam is bonded to said outer vinyl and said inner foam surface. A high-density polyethylene non-deformable insert, substantially trapezodial in shape and the lower edge of which is adapted to fall above the mastoid bone, is bonded to and between said intermediate foam and said inner foam. Attached to each ear guard is a top head strap to pass over the top of the wearer's head. Also there is a rear head strap attached to each ear guard to pass behind the wearer's head. The ends of said straps have engaging means to adjustably engage the straps of the respective ear guards comprising the loops from a loop-hook fastener on the exterior surface of the inner foam surface of one of the ear guards and the hooks from a loop-hook fastener on the exterior surface of the vinyl surface of the other of the ear guards. A strap having elastic loops at each end which surround the joined engaging means hold the hook and loop fasteners in engagement. A releasable chin strap releasably connects the lower portions of the ear guard to engage the wearer's chin.

DESCRIPTION OF THE DRAWINGS

A more detailed and complete appreciation of the invention and many of its features will be readily apparent by reference to the following description when considered in connection with the accompanying drawings.

FIG. 5 is a plain view of one ear guard of the present invention with integral head straps.

FIG. 6 is a plan view of the reverse side of the ear guard of FIG. 5.

FIG. 7 is a pictorial view of the strap connecting the head straps of the ear guards of the present invention.

DETAILED DESCRIPTION

Figure 1:
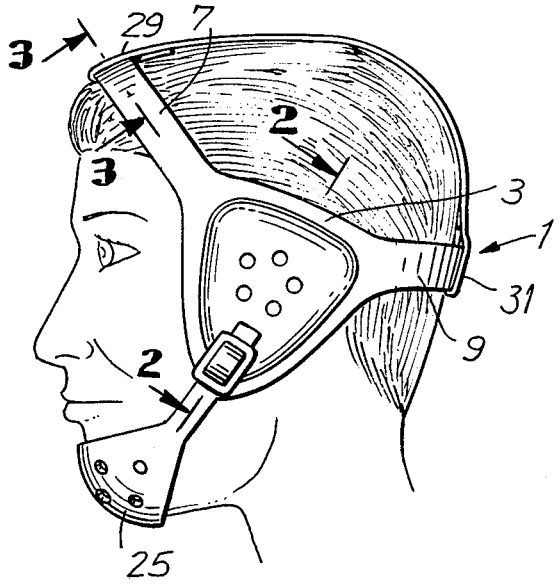
FIG. 1 is a side elevational pictorial view of the head gear on a wearer's head.

The head gear of the present invention is shown upon a wearer's head in FIG. 1. Consistent with the object of the present invention, the preferred embodiment of head gear 1 is both comfortable to wear, of superb commercial quality, and economically competitive with existing head gear. These objects are obtained through a combination of material selection and physical design.

To obtain the aesthetic and commercially pleasing appearance of the present invention, yet meet all of the necessary criteria for a commercially acceptable protective head gear; the preferred embodiment is manufactured through what is known as compression or match molding. As more fully described below, a plurality of synthetic materials are combined in layers and then molded to obtain and meet all the objects of the present invention.

Reference to FIGS. 1, 5 and 6 teaches a protective head gear 1 including two ear guards 3 and 5 (ear guard 5 is not illustrated). Integral with each ear guard is a top head strap 7 and a back head strap 9.

Figure 2:
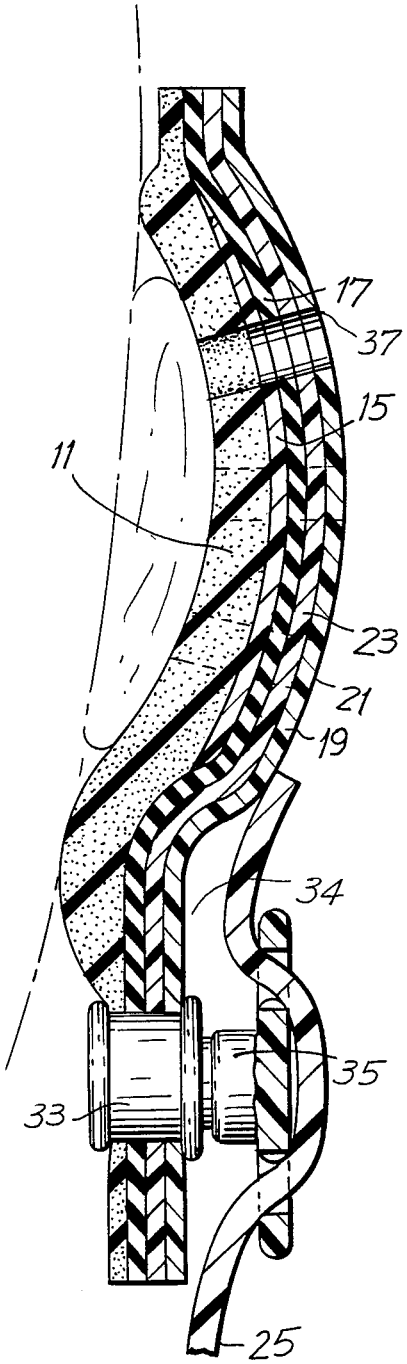
FIG. 2 is a cross-sectional view of the head gear of FIG. 1 along reference line 2—2 showing details of the multi-layered ear guard.
Figure 3:
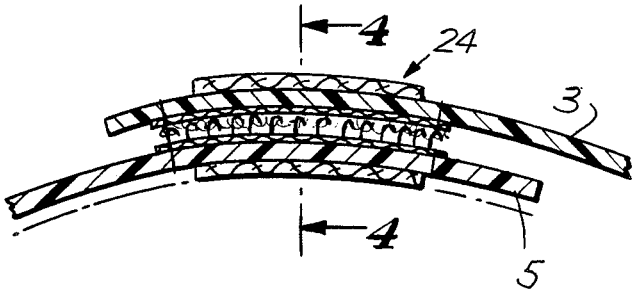
FIG. 3 is a cross-sectional view of the head gear of FIG. 1 along reference line 3—3 showing details of the engaging means for straps joining the ear guards across the top of the wearer's head.
Figure 4:
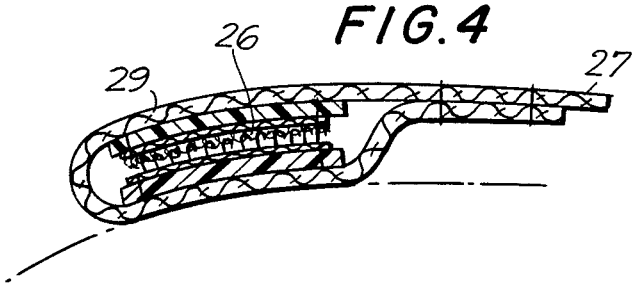
FIG. 4 is a cross-sectional view of the head straps of FIG. 3 along reference line 4—4 showing other details of the engaging means.

In FIG. 2 the detailed construction of ear guard 3 can best be seen. A shock-absorbing inner foam surface 11 is provided with a substantially triangular ridge 13 (see FIG. 6) to engage the head surrounding the ear. Furthermore, ear guard 3 (and 5) contacts the head uniformly through inner foam 11. In the preferred embodiment inner foam 11 is a soft cushioning grade foam such as Uniroyal Ensolite type PE-205S.

A non-deformable impact-resistant insert 15 is bonded to inner foam 11. As can best be seen in FIG. 5 the non-deformable insert 15 is preferably substantial trapezoidal in shape. The bottom edge of insert 15 is above the mastoid bone when ear guard 3 is placed over the ear. The edges of non-deformable insert 15 bear upon ridge 13. Accordingly, only the soft deformable inner foam 11 incorporated in ear guard 3 contacts the sensitive anatomical feature. Thus, insert 15 provides substantial protection against impacts to the ear, without transmitting a sharp shock to the wearer's head. In the preferred embodiment non-deformable insert 15 is made from a high-density polyethylene.

Over and bonded to inner foam 11 and non-deformable insert 15 is an intermediate foam 17. Intermediate foam 17 serves to give a more pleasing appearance, adds additional cushioning and provides a softer feel to the exterior of head gear 1 for the opposing athlete. It also provides a good bond between non-deformable insert 15 and inner foam 11 on the one hand and outer vinyl 19 on the other. In the preferred embodiment intermediate foam 17 is one-eighth-inch-thick cross-linked four-pound (high-density) polyethylene foam.

Outer vinyl 19 is preferrably non-stretchable. Accordingly, it is constructed of an outer vinyl layer 21 laminated to a cloth 23 (nylon in the preferred embodiment). By using such a vinyl laminate a structural rigidity is imparted to head gear 1, preventing stretching during use. It also provides a relatively thin, smooth, but extremely durable, outer surface to head gear 1.

Ear guards 3 and 5 are joined and affixed to the wearer's head by means of top head strap 7, back head strap 9 and a detachable chin strap 25. Respective top head straps 7 and back head straps 9 are joined in the preferred embodiment through engaging means 24 comprising a hook and loop type fastener, such as that known commercially as VELCRO. The left ear guard 3 is shown in FIGS. 5 and 6. In the illustrated embodiment (FIG. 6) left ear guard 3 has the smooth loops 26 of the loop-hook fastener which are attached to the exterior surface of inner foam 11 on both straps 7 and 9. Thus, in the event that the fastener contacts the wearer's head, smooth loops 26 will bear against the skin, rather than the abrasive hooks 28. Hooks 28 are attached to the exterior surface of vinyl 19 of right ear guard 5 on both straps 7 and 9.

A safety strap 27 has loops 29 and 31 at its respective ends. In the preferred embodiment strap 27 is elastic, although other variations are contemplated in the present invention. For example, the entire strap could be made of regular non-elastic cloth, or the loops 29 and 31 only could be elastic. Loops 29 and 31 surround engaging means 24 on straps 7 and 9, respectively, to maintain the hook-loop fasteners in engagement. On the other hand loops 29 and 31 can be made of slid entirely onto either strap so as to permit disengagement of the engaging means 24.

Safety strap 27 also insures that during the athletic activity top head strap 7 is not pulled forward over the front of the wearer's face. The provision of a semi-rigid member between straps 7 and 9 it helps to locate ear guards 3 and 5 and prevents their dislocation through twisting or other movement during the athletic activity.

In the preferred embodiment chin strap 25 is releasably connected to both ear guards 3 and 5. In the illustrative embodiment the male half 33 of a snap fastener is riveted into the lower half of ear guards 3 and 5. Male half 33 sits in a recess 34. Male half 33 sits in a recess 34. At each end of chin strap 25 the female half 35 of the snap fastener is slidably attached. Because of recess 34, female half 35 is below the outer surface of ear guards 3 (and 5) during engagement, and therefore does not interfere or contact opposing athletes during the match. Because of recess 34 female half 35 is below the outer surface of ear guard 3 and 5 and thus does not interfere or contact opposing athletes or mats during the match.

One skilled in the art will recognize that the preferred embodiment of the present invention is uniquely adapted to compression or match molding. By suitably elevating the temperatures of each of its component parts, placing them in a properly formed die, and compressing them under pressure, properly formed and cut ear guards 3 and 5 are obtained.

In this same molding operation ventilation and hearing holes 37 can be molded. However, in the preferred embodiment matching ventilation holes are prepunched in non-deformable insert 15 prior to molding. Similarly, to economize on the molding operation, prior to molding intermediate foam 17 is laminated to outer vinyl 19 by way of commercially available laminating techniques. Using this alternative, only three separate elements, inner foam 11, non-deformable insert 15, and laminated intermediate foam 17 and outer vinyl 19, need be separately inserted into the compression mold.

While the invention has been described in accordance with a specific preferred embodiment with a few modifications, the present invention is not limited. Additional modifications will occur to those skilled in the art. Thus one skilled in the art can create various modifications without departing from the scope of this invention as defined by the following claims.

What is claimed is:

1. A protective head gear for wrestlers including:

(a) a pair of ear guards each comprising:

a shock absorbing inner foam layer having a substantially triangular ridge adapted to engage the head surrounding the ear;

a non-stretchable outer vinyl;

a cross-linked polyethylene intermediate foam layer bonded to said outer vinyl and to said inner foam layer; and a high density polyethylene non-deformable insert substantially trapezoidal in shape and adapted to receive the ear, the lower edge of which is above the mastoid bone, bonded to and between said inner foam and said intermediate foam layers, and the upper and side edges of which substantially contact said ridge of said inner foam layer;

(b) a top head strap integrally attached to each ear guard to pass over the top of the wearer's head;

(c) a rear head strap integrally attached to each ear guard to pass behind the wearer's head;

(d) engaging means to adjustably engage the straps of the respective ear guards comprising:

loops from a loop-hook fastener on the inner surface of said top and rear-head straps of one of said ear guards;

hooks from a loop-hook fastener on the outer surface of said top and rear head straps of the other of said ear guards;

(e) a safety strap having elastic loops at each of its respective ends surrounding said engaging means to hold said engaging means in engagement; and (f) a releasable chin strap releasably connecting said ear guards to engage the wearer's head substantially at his chin.

2. Protective head gear as in claim 1 wherein said ear guard has holes for ventilation and hearing.

3. A protective head gear for a wrestler comprising:

(a) first and second ear guards, each of said ear guards comprising a shock-absorbing inner foam layer having a substantially triangular integrally formed ridge adapted to engage the head surrounding an ear of the user, a smooth non-stretchable outer layer, an intermediate foam layer bonded to said smooth outer layer, and a non-deformable insert which is substantially trapezoidal in shape and adapted to receive said ear, said non-deformable insert being bonded to and between said intermediate and inner foam layers;

(b) first through fourth head straps, said first and second head straps being integrally formed with said first ear guard and said third and fourth head straps being integrally formed with said second ear guard;

(c) first through fourth engaging means affixed in the vicinity of the ends of said first through fourth head straps respectively, said first and second engaging means being affixed on the outer surfaces of said first and second head straps respectively, and said third and fourth engaging menas being affixed to the inner surfaces of said third and fourth head straps respectively;

(d) a releasable chin strap for releasably connecting said first and second ear guards, said chin strap being adapted to receive the chin of said user, and (e) a safety strap having a first loop at one end and a second loop at the other end, wherein said first and third engaging means are adjustably engageable on the top and said second and fourth engaging means are adjustably engageable at the back of the head of said user, and said safety strap is slidable so that said first loop surrounds said first and third engaging means during their engagement, and said second loop surrounds said second and fourth engaging means during their engagement when said safety strap is in the securement position, and said engaging means are respectively disengageable when said safety strap is slid out of said securement position.

4. A protective head gear as recited in claim 5, wherein each of said first and second engaging means comprises the hooks of a loop-hook type fastener, and each of said third and fourth engaging means comprises the loops of said loop-hook type fastener.

5. A protective head gear as recited in claim 3 wherein said loops of said safety strap are made of elastic material.

6. A protective head gear as recited in claim 3, wherein each of said ear guards is provided with holes for ventilation and hearing.

7. A protective head gear as recited in claim 3, wherein each of said head straps is integrally formed with said outer layer of said respective ear guard.

* * * * *